United States Patent [19]

Bithrey

[11] 4,398,682

[45] Aug. 16, 1983

[54] DISPLACEMENT MECHANISM

[75] Inventor: Alan R. Bithrey, Kensworth, England

[73] Assignee: British Aerospace Public Limited Company, London, England

[21] Appl. No.: 186,265

[22] Filed: Sep. 11, 1980

[30] Foreign Application Priority Data

Sep. 18, 1979 [GB] United Kingdom ..... 7931435

[51] Int. Cl.[3] ..... F42B 13/32

[52] U.S. Cl. ..... 244/3.29; 91/61; 91/530; 92/2; 244/49; 244/52; 244/78

[58] Field of Search ..... 92/2, 120, 121, 122; 91/61, 530, 210, 216 R; 244/3.24–3.3, 45 A, 49, 52, 78, 207, 213

[56] References Cited

U.S. PATENT DOCUMENTS

| | | | |
|---|---|---|---|
| 1,982,656 | 12/1934 | Gilman | 91/61 |
| 2,459,902 | 1/1949 | Tucker | 91/61 |
| 3,563,495 | 2/1971 | Korn | 244/3.29 |
| 3,620,132 | 11/1971 | Nitkiewicz | 92/2 |
| 3,695,556 | 10/1972 | Gauzza | 244/3.28 |
| 3,766,831 | 10/1973 | Yeakley | 92/122 |
| 4,005,641 | 2/1977 | Nussbaumer | 92/2 |
| 4,138,206 | 2/1979 | Zenevich et al. | 92/120 |

*Primary Examiner*—Harold J. Tudor

*Attorney, Agent, or Firm*—Cushman, Darby & Cushman

[57] ABSTRACT

A displacement mechanism for effecting both rotary movement of a movable member (for example a fin) with respect to a fixed member (for example a flight vehicle body) from a first, inoperative position to a second, operative position about a longitudinal axis and axial movement of the movable member along that axis to effect subsequent locking in the second position, comprises a fluid operated vane motor to effect rotation and a fluid operated piston/cylinder arrangement to effect the axial movement. Preferably the vane motor and the piston/cylinder arrangement are closely integrated one with another.

2 Claims, 9 Drawing Figures

DISPLACEMENT MECHANISM

This invention relates to displacement mechanisms for rotating a movable member with reference to a fixed member. For example, the movable member may be a wing, vane, fin, or similar surface having an airfoil function, whilst the fixed member may be a body of a flight vehicle on which the movable member is carried, it being desired to rotate the movable member from an inoperative stowed position to an operative position. Alternatively, the movable member may be a closure member, a shutter, or other device associated with some fixed apparatus.

The invention has for an objective the provision of a compact mechanism capable of exerting high operating forces upon the movable member. The invention has for a further objective the ready provision of locking means by which the movable member may be held in a given position such as the operative position.

According to the present invention a displacement mechanism for effecting rotary movement of a movable member with respect to a fixed member from a first position to a second position about a given axis and for effecting axial movement of the movable member along the axis to effect locking in the second position, including fluid operated vane motor means to effect the rotary movement, and fluid operated urging means to effect the axial movement.

Figure 1:
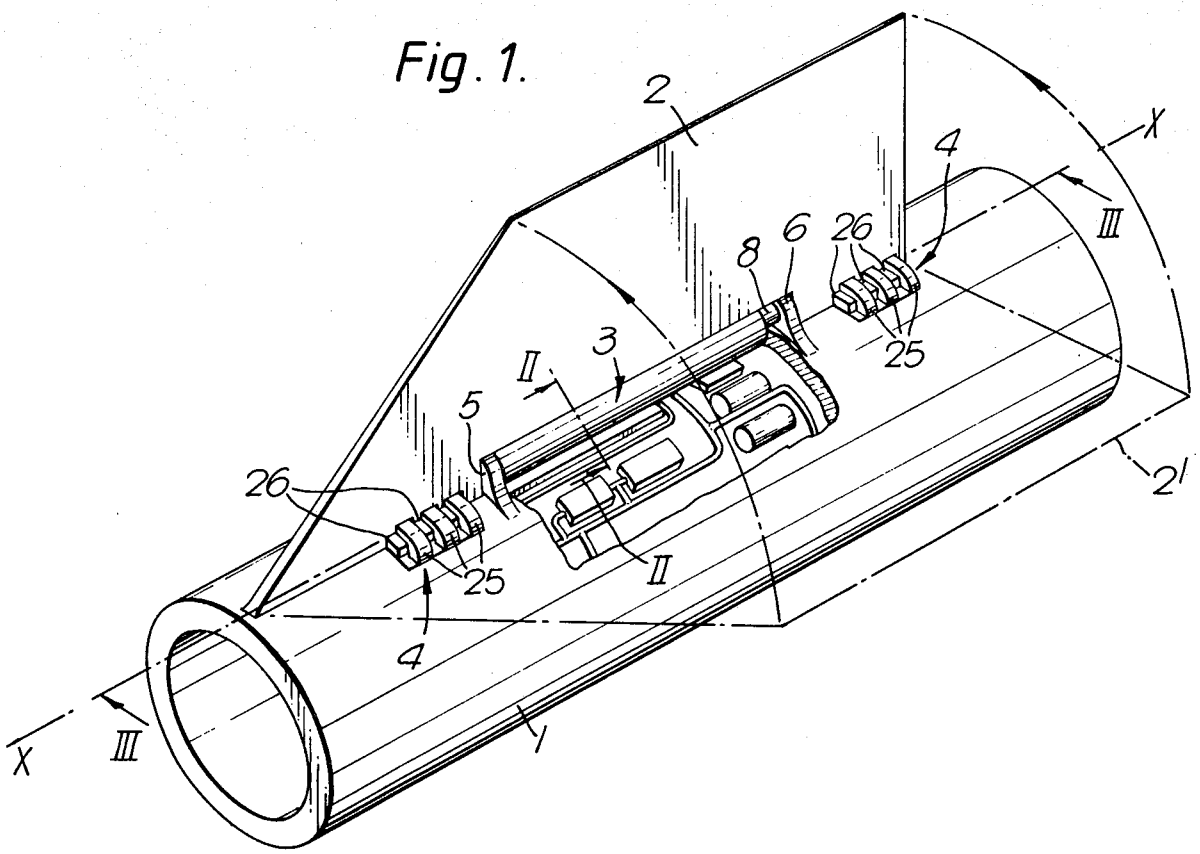
Figure 2A:
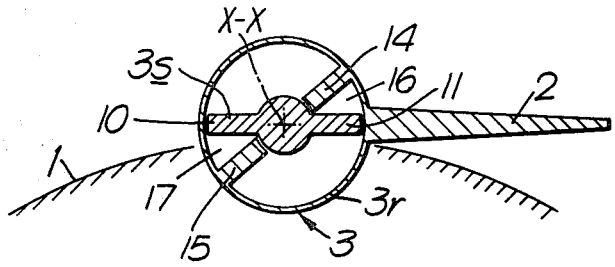
Figure 2B:
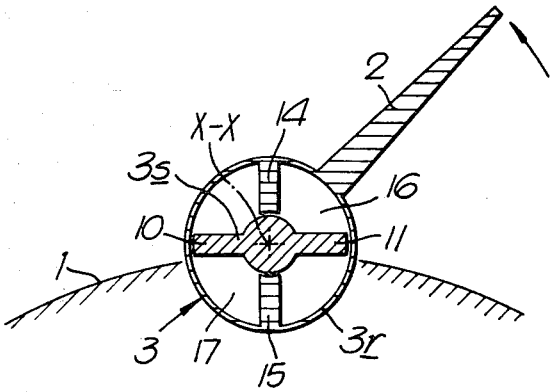
Figure 3:
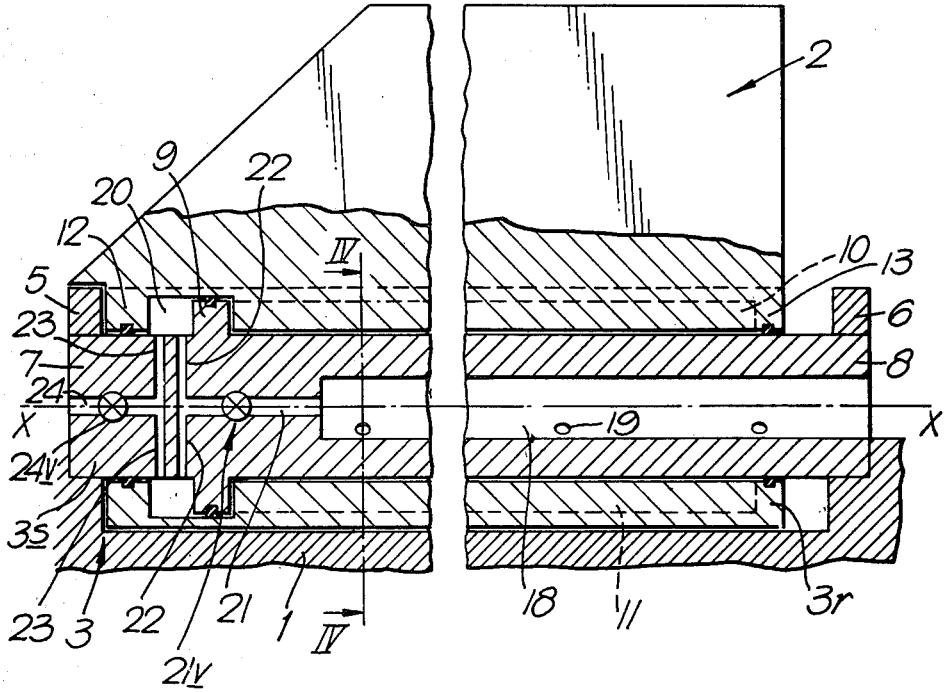
Figure 4:
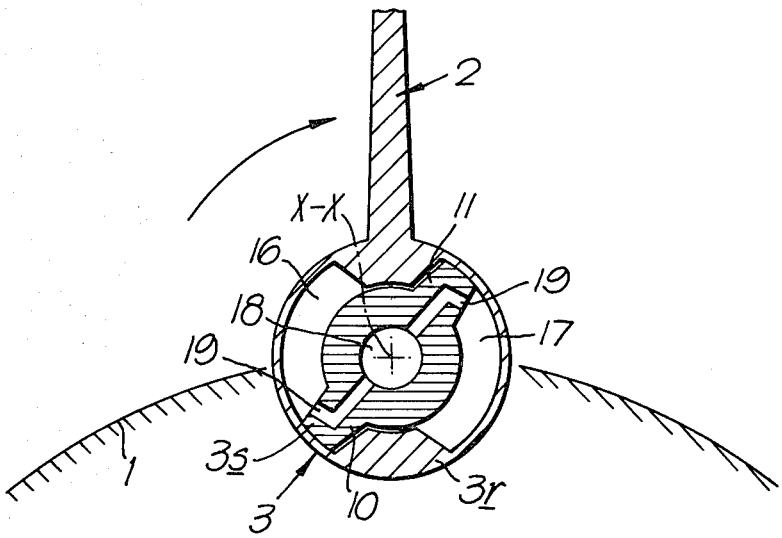
Figure 5:
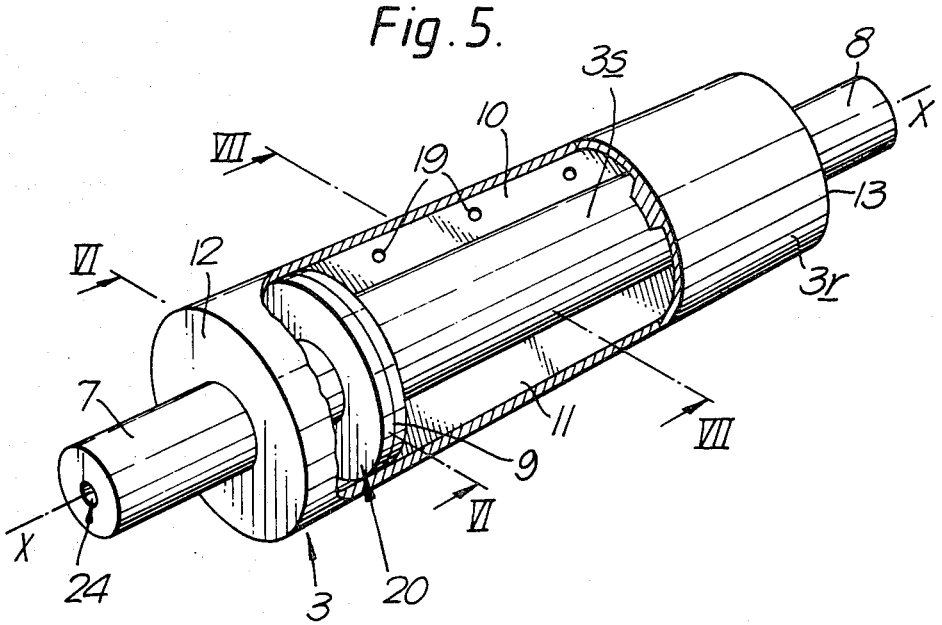
Figure 6:
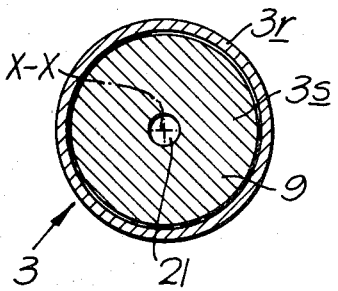
Figure 7:
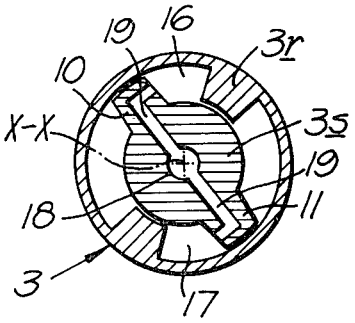

One embodiment of a displacement mechanism according to the invention is described with reference to the accompanying drawings in which:

FIG. 1 is a perspective view of part of a flight vehicle, in this case a guided weapon, FIGS. 2*a, b,* and *c* are simplified cross-sectional views to a larger scale showing a sequence of operation, the sections being taken upon arrows II—II of FIG. 1, FIG. 3 is a cross-section in a plane including the fore and aft axis of the mechanism, that is to say upon arrows III—III of FIG. 1, FIG. 4 is a cross-section upon arrows IV—IV of FIG. 3, FIG. 5 is a partially cut-away enlarged perspective view of the mechanism itself, FIG. 6 is a cross-section upon arrows VI—VI of FIG. 5, and, FIG. 7 is a cross-section upon arrows VII—VII of FIG. 5.

Figure 2C:
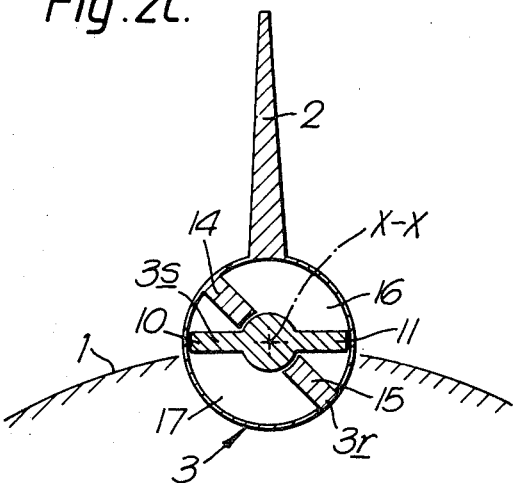

In the Figures a guided weapon has a body 1, a fin 2 which is arranged to be rotated through about 90° from an inoperative position, shown in broken outline at $2^1$ in FIG. 1 and in solid outline in FIG. 2*a,* to an operative position shown in solid outline in FIG. 1, in FIG. 2*c,* and in FIGS. 3 and 4, about a fore and aft axis X—X, a fluid operated vane motor 3 to effect such rotation, and locking means 4, FIG. 1, to hold the fin 2 in the operative position.

The locking means 4 require axial movement of the fin 2 along the axis X—X. This is effected by urging means incorporated within the vane motor in a manner to be described.

The body 1 carries twin axially spaced lugs 5 and 6 respectively which provide a mounting for the motor 3 and for the fin 2 since the latter is carried by the motor. The axis of rotation of the motor lies co-axially with the axis X—X.

The motor itself essentially comprises two co-axially mating parts, a stator 3*s* and a rotor 3*r*. The stator 3*s* is in the form of a cylindrical shaft having a forward extremity 7 fixedly engaged with the lug 5 and a rearward extremity 8 fixedly engaged with the lug 6, so that the stator 3*s* cannot rotate with reference to the body. Intermediate its extremities, but nearer the forward extremity 7, the stator 3*s* is formed with an annular flange 9 of a diameter greater than that of the shaft itself. Extending from the flange 9 towards the rear extremity 8, but terminating before that extremity is reached, the stator has fixed diametrically opposed radially outwardly protruding and axially extending vanes 10 and 11. The rotor 3*r* is in the form of a cylindrical tube through which the stator 3*s* extends, the tube being shorter than the stator and having, at its forward extremity, a closure flange 12 and, at its rearward extremity, a closure flange 13. These two flanges, in addition to effecting sealing engagement with the stator 3*s* also provide bearing surfaces so that both relative rotation and limited axial movement between the rotor and stator can be smoothly effected. The rotor 3*r* is further formed with fixed diametrically opposed radially inwardly protruding and axially extending vanes 14 and 15 which lie between the vanes 10 and 11 of the stator 3*s*. The vanes 14 and 15 extend from the closure flange 13 to sealingly contact the annular flange 9 on the stator 3*s* when the rotor is in that forward position illustrated in the Figures generally and specifically in FIG. 3. Naturally, the periphery of the flange 9 is slidingly sealed against an interior surface of the stator rotor 3*r* at all times. Similarly, the tips of the vanes 10 and 11 slidingly seal against mating regions of the interior of the rotor 3*r* whilst vanes 14 and 15 seal against mating regions of the exterior of the stator 3*s*.

As before mentioned, with the rotor 3*r* in its forward position shown in FIG. 3, the forward ends of the vanes 14 and 15 sealingly engage with an aft face of the flange 9. Similarly, the rearward ends of the vanes 10 and 11 sealingly engage an interior face of the closure flange 13.

The effect of sealing is to provide twin chambers 16 and 17. Pressure fluid is supplied to these chambers to effect rotation of the rotor 3*r,* the fluid being derived from a source, not being part of the invention, of pressurised liquid or alternatively pressurised gas. The supply is by way of ducts 18 and 19 extending through the lug 6, axially through the stator 3*s* and radially through each vane 10 and 11 to exit in those flanks of the vanes forming walls of the chambers 16 and 17. When pressurised, the chambers 16 and 17 exert a torque to rotate the rotor.

A further effect of sealing is to provide an annular chamber 20 between the forward face of the flange 9 and the forward closure flange 12. Pressure fluid to maintain the rotor 3*r* in its forward position of FIG. 3 is supplied by way of a forward continuation 21 of the duct 18 and further radial ducts 22 to the annular chamber 20. A cut-off valve 21*v* is situated in the duct 21. Further radial ducts 23 communicating with an axial duct 24 allow controlled venting of the chamber 20. To effect control, a cut-off valve 24*v* is situated in the duct 24.

The locking means 4 provided to hold the fin 2 in the operative position comprise a forward set and a rearward set of engagement members carried by the body 1 and respectively co-operating sets of engagement members carried by the fin 2. The sets respectively lie in front of and to the rear of the motor 3. As shown in FIG. 1, each set of engagement members on the body 1 includes three spaced pairs of cantilevered deformable fingers 25, the fingers of each pair being directed towards each other with their free ends sufficiently spaced to allow the fin 2 to extend between them. Each set of engagement members on the fin 2 include three spaced pairs of laterally outwardly extending fingers 26 which are positioned clear of the pairs of fingers 25 to allow rotation of the fin 2 when in its forward position, but which are urged underneath the pairs of fingers 25 to lie in register with them when the fin is subsequently moved axially rearwardly. The fingers 26 are chosen of such a thickness that in so doing the fingers 25 are deformed to exert a strong clamping force.

In operation, assuming the fin 2 to be in the non-operative position $2^1$ of FIG. 1 and FIG. 2*a*, (which position renders the weapon suitable for stowage in a rectangular section storage/launching device) pressure fluid at about 10,000 psi is supplied both to the chambers 16 and 17 along ducts 18 and 19 and also to the chamber 20 along ducts 21 and 22 since the valve 21*v* is open. The valve 24*v* is closed. The pressure in chamber 20 thus maintains the fin 2 in the forward position, as shown in FIG. 3, which ensures sealing of the chambers 16 and 17 and also maintains the pairs of fingers 25 and 26 of the locking means out of register, so that rotation about the axis X—X toward the operative position can be freely effected by means of the pressure in the chambers 16 and 17. When the operative position of the fin 2 is reached, the valve 21*v* is closed and the valve 24*v* is opened so that pressure fluid is vented from the chamber 20 but the pressure fluid within the rotor between the rear closure flange 13, the stator shaft, and the flange 9, is maintained so that the rotor 3*r* is moved axially rearwardly to effect locking of the locking means 4.

The operation of the valves 21*v* and 24*v* at the desired time may be effected electro-magnetically by a triggering arrangement using electronic position sensors which sense the relative rotational positions of the rotor and the stator, or by an arrangement of ports covered and uncovered by the relative rotation of the rotor and the stator.

I claim:

1. A flight vehicle having:

body means;

fin means capable of rotary movement from an inoperative position to an operative position about an axis and of axial movement along said axis to effect locking;

displacement mechanism to effect such rotary and such axial movement; and locking means to effect locking on such axial movement;

said displacement means including vaned stator shaft means fixedly carried by said vehicle body means;

vaned rotor cylinder means carrying said fin means, said stator shaft means extending co-axially through said rotor means in sealing engagement therewith to provide a torque and an axial force producing pressure fluid chamber and to also provide a further axial force producing pressure fluid chamber;

duct means for supplying pressure fluid to said torque and axial force producing pressure fluid chamber; and further duct means for supplying pressure fluid to said further axial force producing pressure fluid chamber, said further duct means having valve means effective to supply pressure fluid to said further chamber thereby to prevent movement of said fin means until rotational movement is complete and subsequently to allow venting of said further chamber while supply of pressure fluid is continued to said torque and axial force producing pressure fluid chamber thereby to effect axial locking movement.

2. A flight vehicle according to claim 1, wherein the locking means comprises at least one pair of deformable fingers positioned to be engaged and deformed by a further pair of fingers by axial movement of the rotor means.

* * * * *